US005818317A

United States Patent [19]

Takagishi

[11] Patent Number: 5,818,317

[45] Date of Patent: Oct. 6, 1998

[54] DEFLECTION YOKE

[75] Inventor: Toshiya Takagishi, Kanagawa, Japan

[73] Assignee: Sony Corporation, Tokyo, Japan

[21] Appl. No.: 772,889

[22] Filed: Dec. 24, 1996

[30] Foreign Application Priority Data

Dec. 27, 1995 [JP] Japan ..... 7-351290

[51] Int. Cl.[6] ..... H01F 1/00

[52] U.S. Cl. ..... 335/212; 335/211

[58] Field of Search ..... 335/210–214; 313/440; 348/828–831

[56] References Cited

U.S. PATENT DOCUMENTS

| | | | |
|---|---|---|---|
| 3,106,658 | 10/1963 | Chandler et al. | 335/212 |
| 3,296,570 | 1/1967 | Uetake et al. | 335/212 |
| 3,618,125 | 11/1971 | Yabase | 335/212 |
| 4,197,487 | 4/1980 | Takenaka et al. | 315/370 |
| 4,398,166 | 8/1983 | Bumgardner | 335/212 |
| 4,449,109 | 5/1984 | Paddock et al. | 335/212 |
| 4,714,908 | 12/1987 | Watabe et al. | 335/212 |
| 5,227,692 | 7/1993 | Lee | 313/431 |

FOREIGN PATENT DOCUMENTS

| | | | |
|---|---|---|---|
| 2621711 | 11/1977 | Germany | 335/212 |
| 138335 | 10/1979 | Japan | 335/212 |

*Primary Examiner*—Michael L. Gellner
*Assistant Examiner*—Raymond Barrera
*Attorney, Agent, or Firm*—Jay H. Maioli

[57] ABSTRACT

A deflection yoke having upper and lower magnets located at upper and lower positions of the funnel side of a cathode-ray-tube, for correcting upper and lower pin-cushion distortions. The upper and lower magnets are movably held so as to make magnetic fields formed by the magnets variable horizontally or vertically and asymmetrically. Accordingly, asymmetrical image distortion both in a vertical direction and a horizontal direction can be easily corrected.

2 Claims, 12 Drawing Sheets

FIG. IC
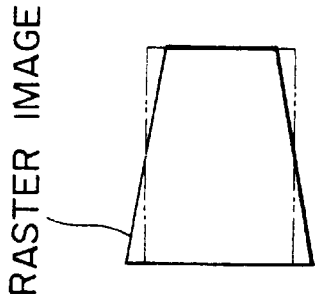
FIG. IB
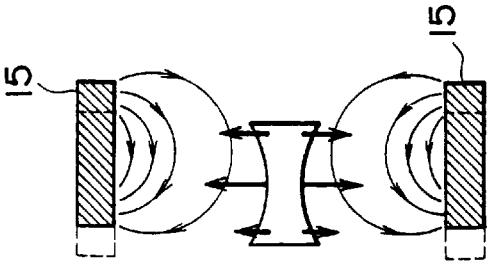
FIG. IA
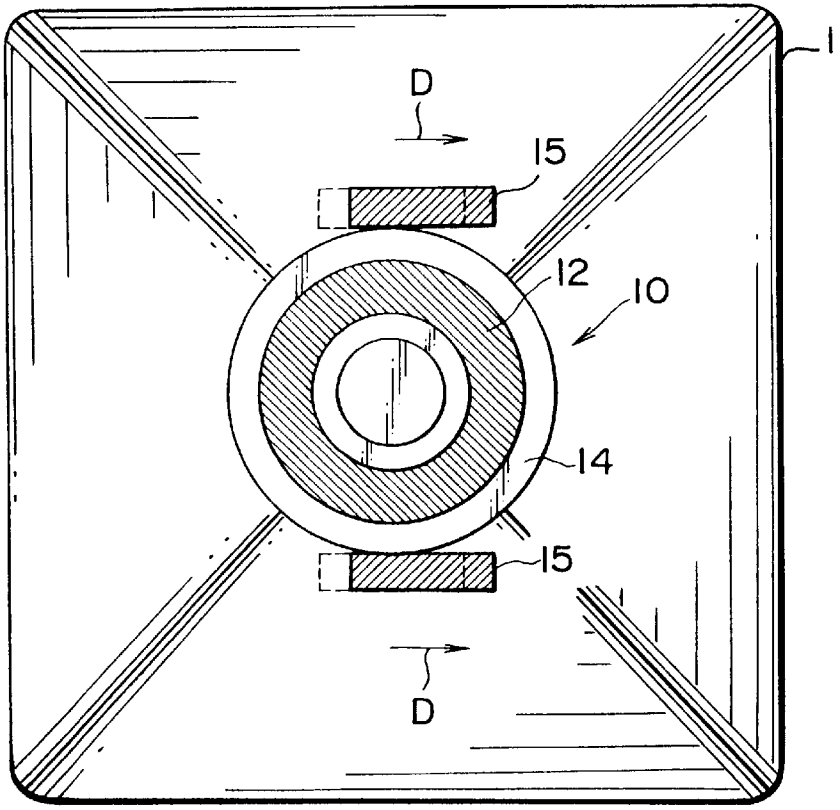

DEFLECTION YOKE

BACKGROUND OF THE INVENTION

1. Field of the Invention

The present invention relates to a deflection yoke, and more particularly to a deflection yoke having upper and lower magnets located at upper and lower positions on a funnel side, for correcting upper and lower pin distortions, which can easily correct image distortion asymmetrical in both a vertical direction and a horizontal direction by moving the upper and lower magnets.

2. Description of Related Art

A conventional deflection yoke has upper and lower magnets located at upper and lower positions on a funnel side, for correcting upper and lower pin distortions.

If the upper and lower magnets are not provided in the deflection yoke, a raster image due to the upper and lower pin distortions as shown in FIG. 12A is formed in a cathode-ray tube. By locating the upper and lower magnets as shown by reference numerals 1 in FIG. 12B, an electron beam scanning the cathode-ray tube receives vertical forces having opposite directions at a central position in a horizontal scanning direction in scanning upper and lower positions deflected from a horizontal axis of the cathode-ray tube. As a result, the upper and lower pin distortions in the raster image can be corrected as shown in FIG. 12C.

Actually, however, there is a possibility that the image distortion of the raster image cannot be perfectly removed even when the accuracies of the deflection yoke and components of the cathode-ray tube are increased, causing image distortion asymmetrical in both a vertical direction and a horizontal direction. As countermeasures against such image distortion, the deflection yoke mounted in the cathode-ray tube is tilted in both the vertical direction and the horizontal direction (so-called swing adjustment) in an adjusting step for the deflection yoke, thereby adjusting the image distortion.

However, this swing adjustment invites not only a change in image distortion, but also a change in convergence characteristics. Accordingly, although the image distortion can be adjusted on one hand, there is a possibility that misconvergence may not perfectly converge on the other hand. Conventionally, misconvergence or the like is corrected by attaching a magnetic member of permalloy or the like on the inner surface of the deflection yoke.

It is considered convenient if such an adjusting operation for image distortion can be simplified. In performing the swing adjustment in particular, both the image distortion and the convergence characteristics are changed as mentioned above. Therefore, if only the image distortion can be adjusted independently of the convergence characteristics in the swing adjustment, it is considered that not only the adjusting operation can be simplified, but also both the convergence characteristics and the image distortion characteristics can be easily controlled to thereby remarkably improve the characteristics of the cathode-ray tube as a unit over the related art.

SUMMARY OF THE INVENTION

It is accordingly an object of the present invention to provide a deflection yoke which can easily correct image distortion asymmetrical in both a vertical direction and a horizontal direction.

According to a first aspect of the present invention, there is provided a deflection yoke having upper and lower magnets located at upper and lower positions on a funnel side, for correcting upper and lower pin distortions, wherein the upper and lower magnets are movably held so as to make magnetic fields formed by the magnets variable horizontally and asymmetrically.

According to a second aspect of the present invention, there is provided a deflection yoke having upper and lower magnets located at upper and lower positions on a funnel side, for correcting upper and lower pin distortions, wherein the upper and lower magnets are movably held so as to make magnetic fields formed by the magnets variable vertically and asymmetrically.

In the first aspect mentioned above, the upper and lower magnets are movably held so that the magnetic fields formed by the magnets can be changed horizontally and asymmetrically. Accordingly, image distortion asymmetrical in a horizontal direction can be corrected by moving the upper and lower magnets as required.

In the second aspect mentioned above, the upper and lower magnets are movably held so that the magnetic fields formed by the magnets can be changed vertically and asymmetrically. Accordingly, image distortion asymmetrical in a vertical direction can be corrected by moving the upper and lower magnets as required.

Other objects and features of the invention will be more fully understood from the following detailed description and appended claims when taken with the accompanying drawings.

BRIEF DESCRIPTION OF THE DRAWINGS

FIG. 1A is an elevational view showing upper and lower magnets relative to a deflection yoke according to an embodiment of the present invention;

FIG. 1B shows forces applied to an electron beam by the magnets of FIG. 1A;

FIG. 1C shows a raster image with trapezoidal distortion;

DETAILED DESCRIPTION OF THE PREFERRED EMBODIMENTS

Some preferred embodiments of the present invention will now be described with reference to the drawings.

(1) First Preferred Embodiment

Figure 2B:
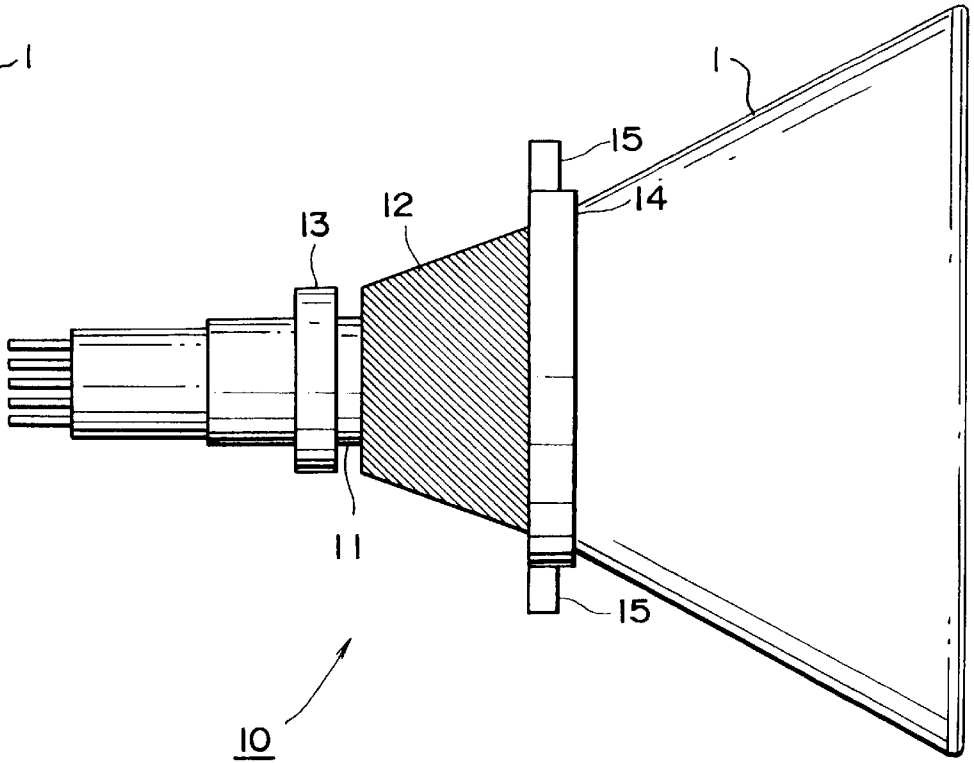
FIG. 2B is a side elevational view of the defection yoke of FIG. 2A.
Figure 2A:
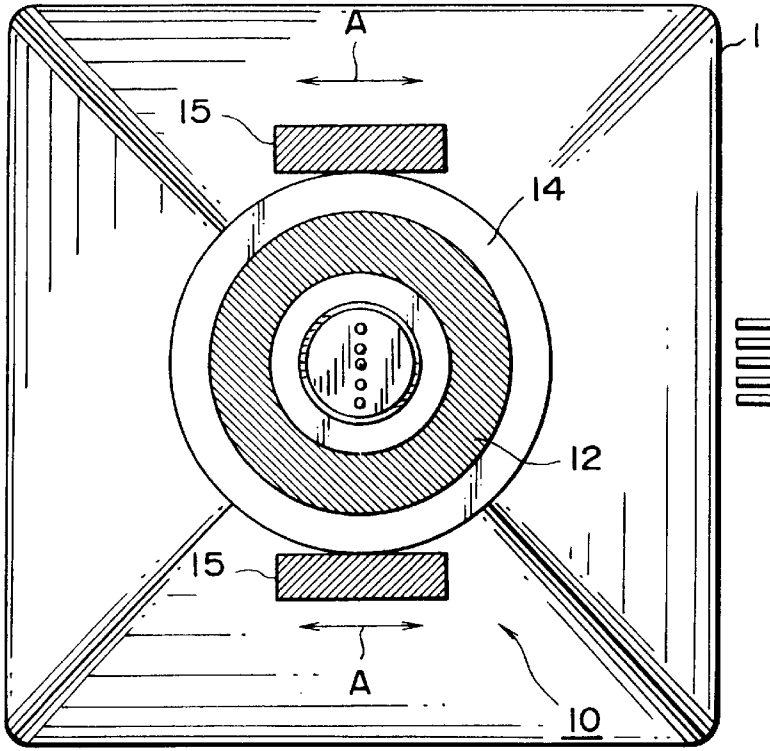
FIG. 2A is a rear elevational view of a deflection yoke according to a first preferred embodiment of the present invention.

FIGS. 2A and 2B are a rear elevational view and a side view, respectively, of a deflection yoke 10 of a cathode-ray tube according to a first preferred embodiment of the present invention. The deflection yoke 10 has a separator 11, a saddle-shaped horizontal deflection coil and a toroidal vertical deflection coil both located inside the separator 11, and a hollow frustoconical core 12 located outside the separator 11 to form magnetic circuits of the horizontal deflection coil and the vertical deflection coil. The deflection yoke 10 further has a front cover 14 located on the funnel side, and has a rear cover and an adjusting ring magnet 13 located on the neck side.

The deflection yoke 10 further has a pair of upper and lower magnets 15 for correcting upper and lower pin distortions. The magnets 15 are located on the funnel side and held horizontally movably as shown by arrows A in FIG. 2A.

Figure 3:
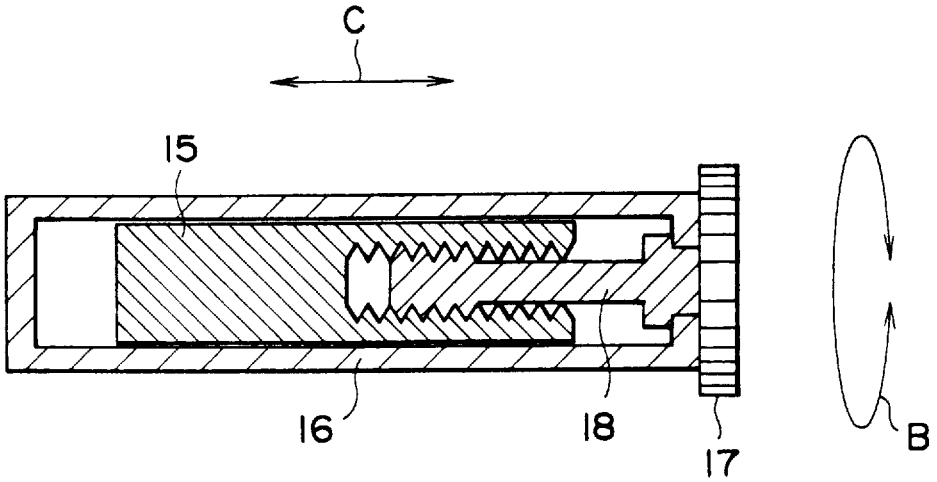
FIG. 3 is a cross-sectional view of a holding mechanism for each magnet.

FIG. 3 is a sectional view showing a holding mechanism for each magnet 15. Each magnet 15 has a rectangular shape, and it is so held as to be accommodated in a sectionally rectangular case 16 formed on the front cover 14. Each magnet 15 is formed with an elongated hole on a longitudinal center line of the magnet 15. The elongated hole is internally threaded and open at one end.

The case 16 is formed with a circular through-hole at one end surface opposed to the opening of the elongated hole of each magnet 15. A disk-shaped adjusting knob 17 having grooves on an outer circumference is located at one end of the through-hole of the case 16. An adjusting rod 18 is connected at one end thereof to the center of the adjusting knob 17, and extends to pass the through-hole of the case 16. The adjusting rod 18 has a front end portion formed with an external thread engaged with the internal thread of the elongated hole of each magnet 15. With this arrangement, each magnet 15 can be horizontally moved bit by bit as shown by an arrow C by rotating the adjusting knob 17 as shown by an arrow B in FIG. 3.

By horizontally moving the upper and lower magnets 15 of the deflection yoke 10 in the same direction as shown by arrows D in FIG. 1A, magnetic fields formed by the upper and lower magnets 15 can be changed horizontally and asymmetrically, so that forces applied to an electron beam scanning a cathode-ray tube 1 can be changed on the same side in a horizontal scanning direction as shown in FIG. 1B. That is, a change in convergence characteristics can be effectively avoided to correct a trapezoidal distortion having one pair of parallel sides extending in a vertical direction as shown in FIG. 1C. Thus, a horizontally asymmetrical image distortion can be corrected.

Figure 4C:
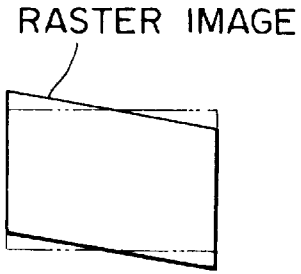
FIG. 4C shows a raster image with parallelogrammatic distortion.
Figure 4B:
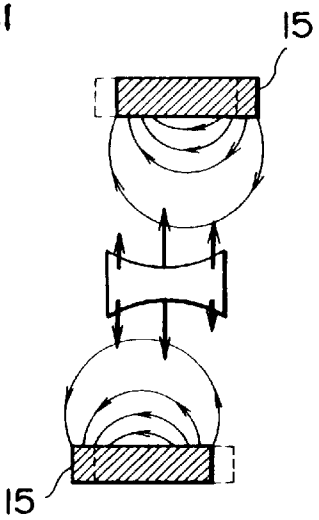
FIG. 4B shows forces applied to the electron beam by the magnets of FIG. 4A.
Figure 4A:
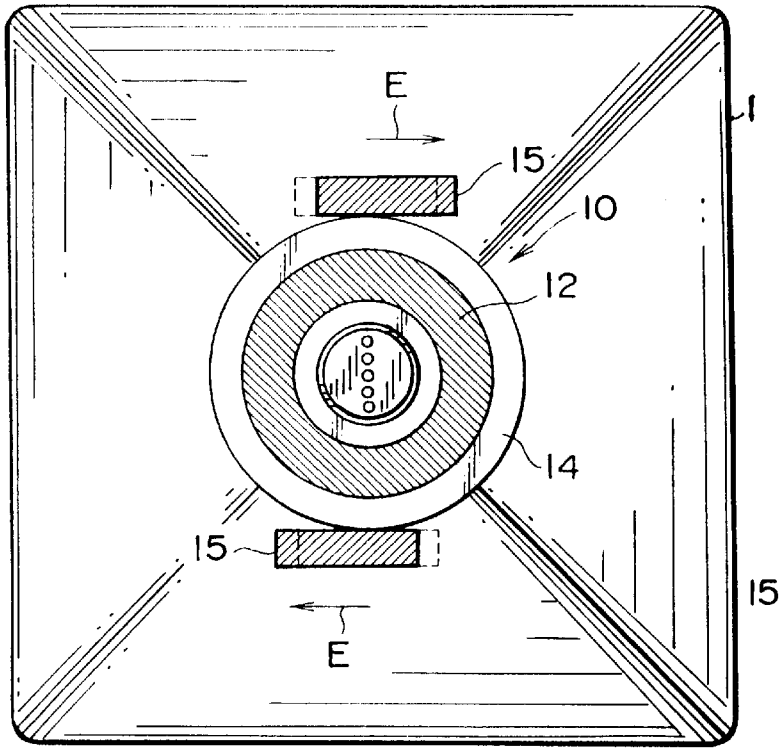
FIG. 4A is an elevational view showing movement of the upper and lower magnets relative to the deflection yoke.

Alternatively, by horizontally moving the upper and lower magnets 15 of the deflection yoke 10 in the opposite directions as shown by arrows E in FIG. 4A, the forces applied to the electron beam scanning the cathode-ray tube 1 can be changed on the opposite sides in the horizontal scanning direction as shown in FIG. 4B. That is, a change in convergence characteristics can be effectively avoided to correct a parallelogrammatic distortion having one of the two pairs of parallel sides extending in a vertical direction as shown in FIG. 4C.

According to the first preferred embodiment shown in FIGS. 1A to 4C, the upper and lower magnets 15 are held so as to be movable horizontally, thereby making the magnetic fields formed by the magnets 15 variable horizontally and asymmetrically. As a result, a change in convergence characteristics can be effectively avoided to effect the correction of a horizontally asymmetrical image distortion.

Accordingly, the image distortion correction can be made independently of the convergence characteristics to improve the characteristics of the cathode-ray tube 1 as a unit. Further, variations in accuracy of the cathode-ray tube, the magnets, etc. in manufacturing the cathode-ray tube can be absorbed. In particular, even when the magnets have large variations in accuracy, they may be used to thereby improve the yield.

(2) Second Preferred Embodiment

Figure 5B:
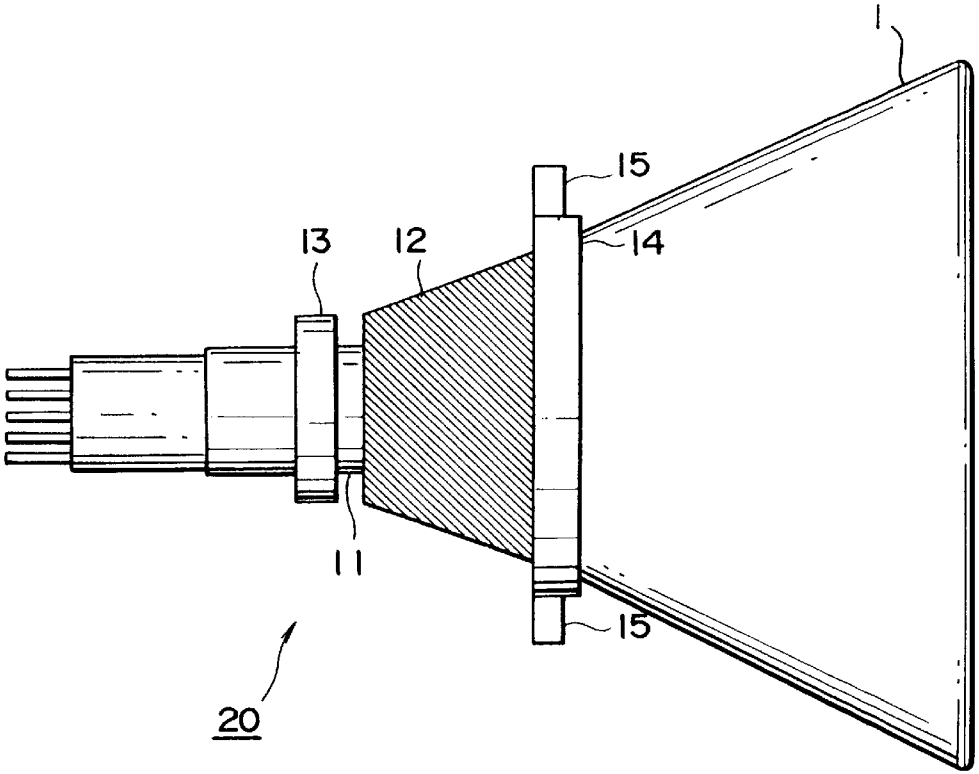
FIG. 5B a side elevational view of the deflection yoke of FIG. 5A.
Figure 5A:
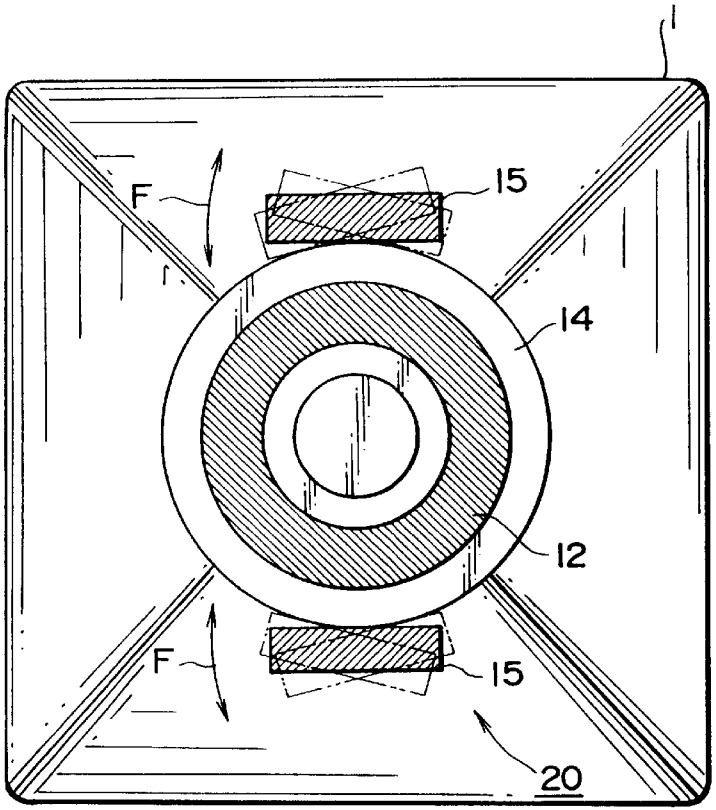
FIG. 5A is a rear elevational view of a deflection yoke according to a second preferred embodiment of the present invention.

FIGS. 5A and 5B are a rear elevational view and a side view, respectively, of a deflection yoke 20 according to a second preferred embodiment of the present invention. The deflection yoke 20 is configured so that upper and lower magnets 15 can be rotated about their substantial centers in a plane perpendicular to the horizontal axis of a cathode-ray tube 1 as shown by arrows F in FIG. 5A. The other configuration shown in FIGS. 5A and 5B is the same as that shown in FIGS. 2A and 2B. In the other configuration, the same parts as those shown in FIGS. 2A and 2B are denoted by the same reference numerals, and the description thereof will be omitted herein to avoid repetition.

Figure 6:
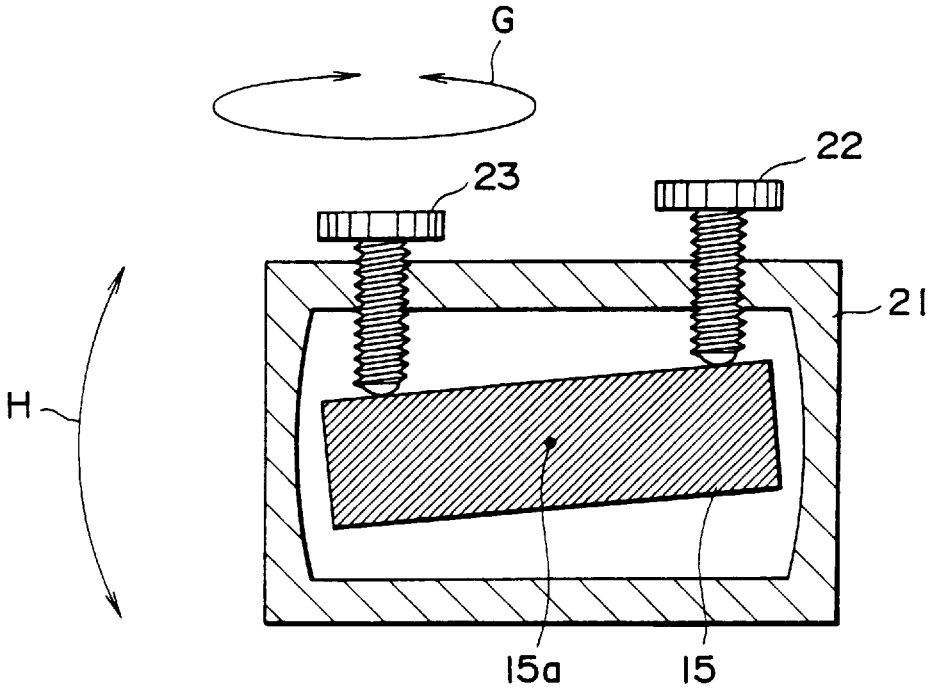
FIG. 6 is a cross-sectional view of a holding mechanism for each magnet.

FIG. 6 is a sectional view showing a holding mechanism for each magnet 15. Each magnet 15 is held so as to be accommodated in a sectionally rectangular case 21 formed on a front cover 14. Each magnet 15 has a rectangular shape, and is rotatably supported to the case 21 by a pair of projections 15*a* formed on the opposite side surfaces of each magnet 15 at its substantially central position.

The case 21 has an upper end surface formed with a pair of tapped holes at right and left end positions. A pair of adjusting screws 22 and 23 are threadedly engaged with the tapped holes of the case 21. More specifically, each of the adjusting screws 22 and 23 is composed of a disk-shaped head formed with grooves on an outer circumference and a threaded stem extending from the center of the disk-shaped head. By rotating the adjusting screws 22 and 23 in opposite directions as shown by an arrow G in FIG. 6, each magnet 15 is pressed by the tips of the threaded stem of the adjusting screws 22 and 23 to rotate bit by bit about the projections 15*a* as shown by an arrow H.

Figure 7C:
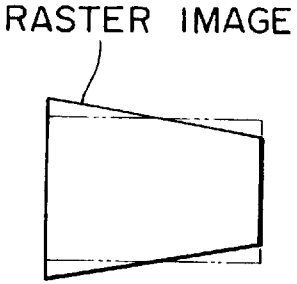
FIG. 7C shows a raster image with trapezoided distortion.
Figure 7B:
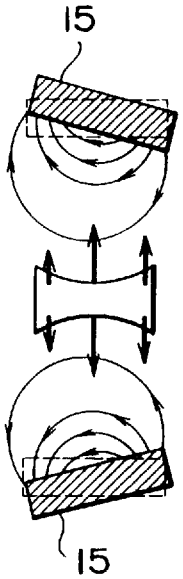
FIG. 7B shows forces applied to the electron beam by the magnets of FIG. 7A.
Figure 7A:
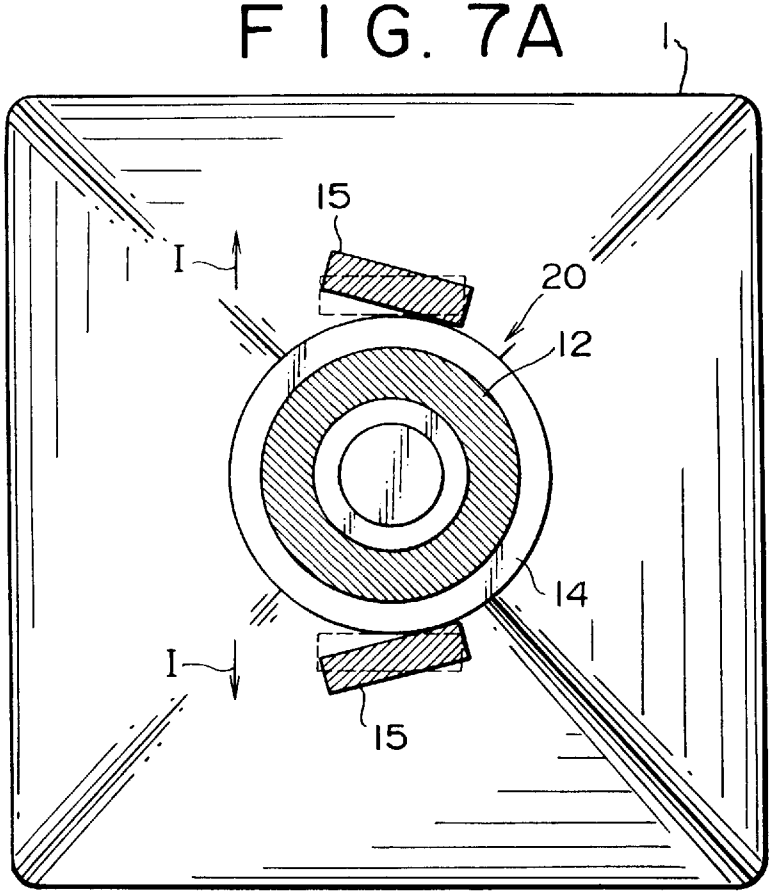
FIG. 7A is an elevational view showing movement of the upper and lower magnets relative to the deflection yoke.

By rotating the upper and lower magnets 15 of the deflection yoke 20 in opposite directions as shown by arrows I in FIG. 7A, magnetic fields formed by the magnets 15 can be changed horizontally and asymmetrically, so that forces applied to an electron beam scanning a cathode-ray tube 1 can be changed on the same side in a horizontal scanning direction as shown in FIG. 7B. That is, a change in convergence characteristics can be effectively avoided to correct a trapezoidal distortion having one pair of parallel sides extending in a vertical direction as shown in FIG. 7C.

Alternatively, the magnets 15 may be rotated in the same direction. In this case, a change in convergence characteristics can be effectively avoided to correct a parallelogrammatic distortion having one of the two pairs of parallel sides extending in a vertical direction.

According to the second preferred embodiment shown in FIGS. 5A to 7C, the upper and lower magnets 15 are held so as to be rotatable in a plane perpendicular to the horizontal axis of the cathode-ray tube 1, thereby making the magnetic fields formed by the magnets 15 variable horizontally and asymmetrically. As a result, the same effect as that of the first preferred embodiment can be obtained.

(3) Third Preferred Embodiment

Figure 8A:
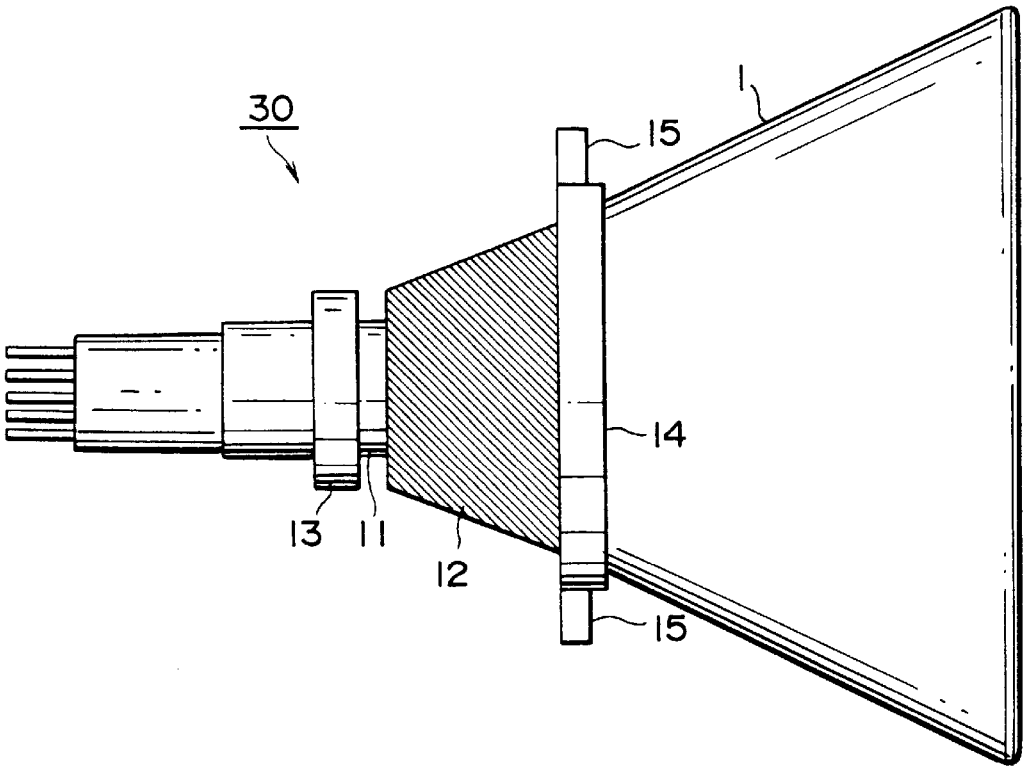
FIG. 8A is a side view of a deflection yoke and magnets according to a third preferred embodiment of the present invention.
Figure 8B:
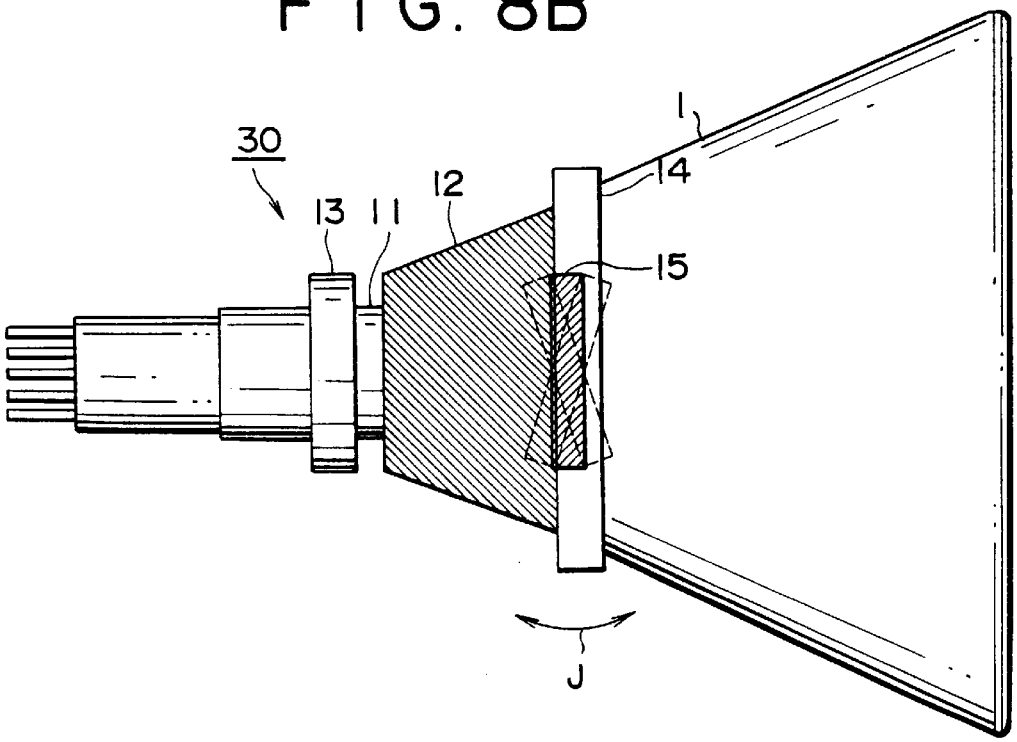
FIG. 8B is a plan view of the deflection yoke and magnets of FIG. 8A.

FIGS. 8A and 8B are a side view and a plan view, respectively, of a deflection yoke 30 according to a third preferred embodiment of the present invention. The deflection yoke 30 is configured so that upper and lower magnets 15 can be rotated about their substantial centers in planes parallel to the horizontal axis of a cathode-ray tube 1 as shown by an arrow J in FIG. 8B. The other configuration shown in FIGS. 8A and 8B is the same as that shown in FIGS. 2A and 2B. In the other configuration, the same parts as those shown in FIGS. 2A and 2B are denoted by the same reference numerals, and the description thereof will be omitted herein to avoid repetition.

Each magnet 15 is held to a front cover 14 so as to be rotatable in a plane parallel to the horizontal axis of the cathode-ray tube 1 by a holding mechanism similar to that of the second preferred embodiment as shown in FIG. 6.

By rotating the upper and lower magnets 15 of the deflection yoke 30 in opposite directions, magnetic fields formed by the magnets 15 can be changed horizontally asymmetrically, so that a change in convergence characteristics can be effectively avoided to correct a trapezoidal distortion having one pair of parallel sides extending in a vertical direction. Alternatively, by rotating the upper and lower magnets 15 in the same direction, a change in convergence characteristics can be effectively avoided to correct a parallelogrammatic distortion having one of the two pairs of parallel sides extending in a vertical direction.

According to the third preferred embodiment shown in FIGS. 8A and 8B, the upper and lower magnets 15 are held so as to be rotatable in planes parallel to the horizontal axis of the cathode-ray tube 1, thereby making the magnetic fields formed by the magnets 15 variable horizontally and asymmetrically. As a result, the same effect as that of the first preferred embodiment can be obtained.

(4) Fourth Preferred Embodiment

Figure 9C:
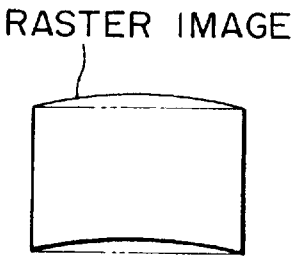
FIG. 9C shows a raster image with pin-cushion distortion.
Figure 9B:
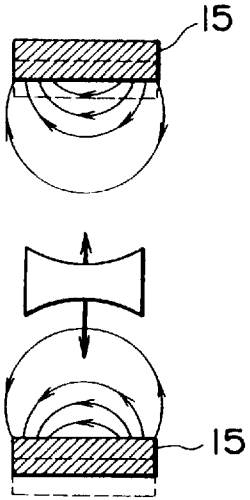
FIG. 9B shows forces applied to the electron beam by the magnets of FIG. 9A.
Figure 9A:
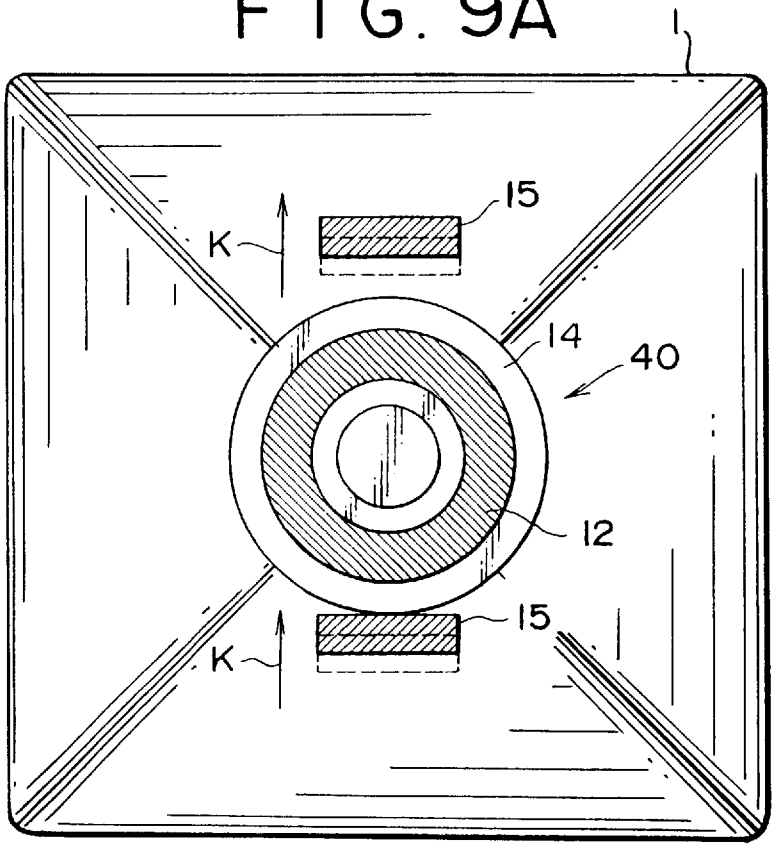
FIG. 9A is an elevational view showing movement of the magnets relative to the deflection yoke.

FIGS. 9A to 9C are schematic views illustrating correction of image distortion by a deflection yoke 40 according to a fourth preferred embodiment of the present invention. The deflection yoke 40 is configured so that upper and lower magnets 15 are held so as to be vertically moved in a plane perpendicular to the horizontal axis of a cathode-ray tube 1. Each magnet 15 is held by a holding mechanism similar to that shown in FIG. 3.

By moving the upper and lower magnets 15 of the deflection yoke 40 vertically in the same direction as shown by arrows K in FIG. 9A, magnetic fields formed by the magnets 15 can be changed vertically and asymmetrically, so that forces applied to an electron beam scanning a cathode-ray tube 1 can be changed on the upper and lower sides in a vertical scanning direction as shown in FIG. 9B. Accordingly, a change in convergence characteristics can be effectively avoided to correct the vertically unbalanced amounts of upper and lower pin distortions in the same direction as shown in FIG. 9C.

Figure 10C:
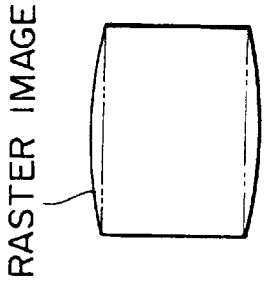
FIG. 10C shows a raster image with pin-cushion distortion.
Figure 10B:
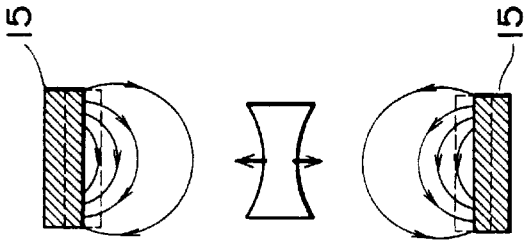
FIG. 10B shows forces applied to the electron beam by the magnets of FIG. 10A.
Figure 10A:
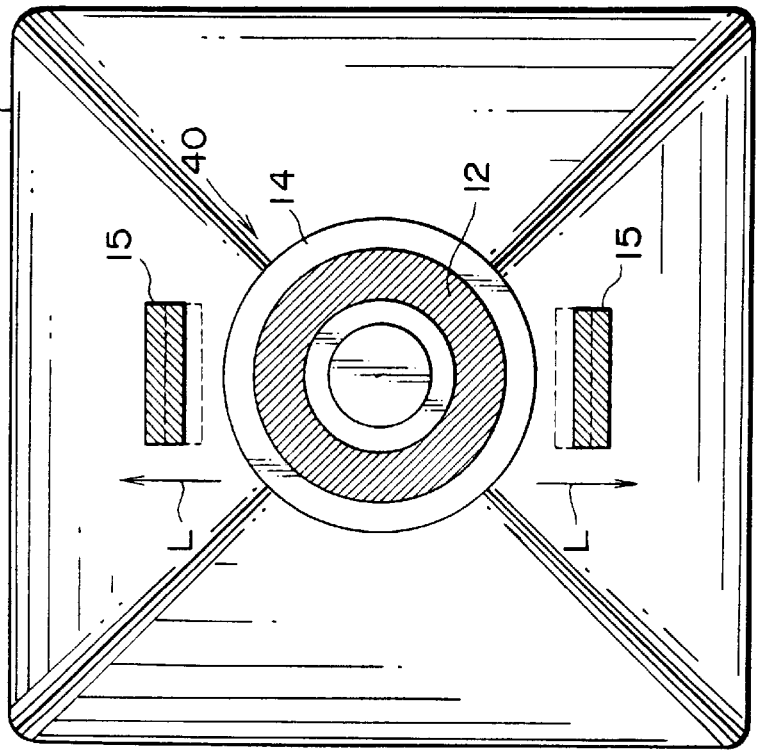
FIG. 10A is an elevational view showing movement of the upper an lower magnets relative to the deflection yoke.

Alternatively, by moving the upper and lower magnets 15 vertically in opposite directions as shown by arrows L in FIG. 10A, the forces applied to the electron beam scanning the cathode-ray tube 1 can be changed on the upper and lower sides in the vertical scanning direction as shown in FIG. 10B. Accordingly, the vertically unbalanced amounts of upper and lower pin distortions can be corrected in the opposite directions as shown in FIG. 10C.

According to the fourth preferred embodiment shown in FIGS. 9A to 10C, the upper and lower magnets 15 are held so as to be vertically movable in a plane perpendicular to the horizontal axis of the cathode-ray tube 1, thereby making the magnetic fields formed by the magnets 15 variable vertically and asymmetrically. Accordingly, a change in convergence characteristics can be effectively avoided to correct image distortion vertically and symmetrical or asymmetrical.

(5) Other Preferred Embodiments

While the upper and lower magnets 15 are moved by rotating the adjusting knobs in the above preferred embodiments, various mechanisms for moving the magnets 15 may be adopted in the present invention. For example, as shown in FIG. 11, a position of each magnet 15 accommodated in a case 41 may be stepwise changed to move each magnet 15.

Figure 11A:
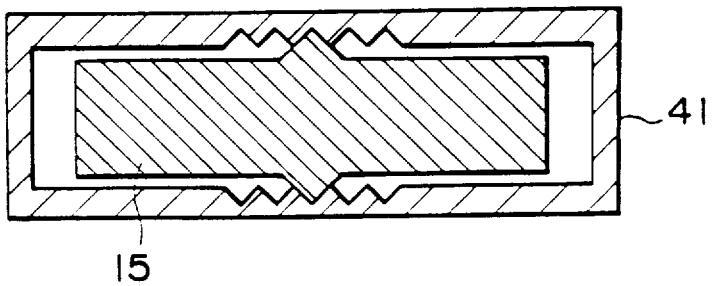
FIG. 11 is a cross-sectional view of a holding mechanism for each magnet.
Figure 11B:
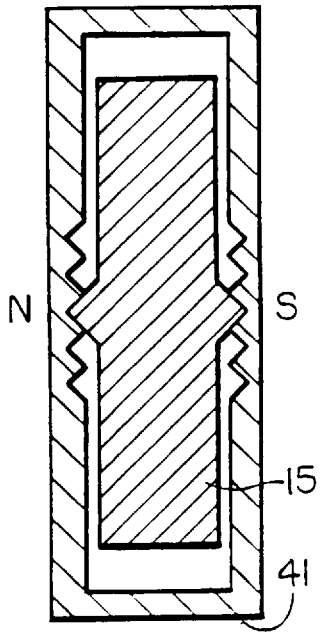
Figure 12A:
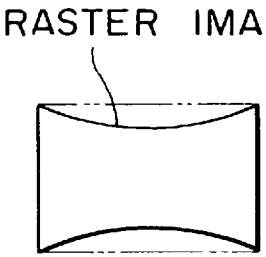
FIG. 12A shows a raster image with upper and lower pin-cushion distortion.
Figure 12B:
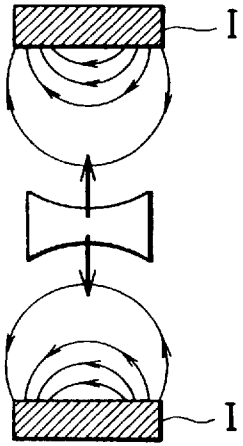
FIG. 12B shows upper and lower magnets and the forces they apply to an electron beam.
Figure 12C:
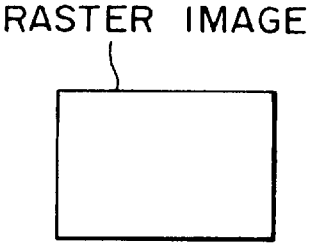
FIG. 12C shows a raster image with distortion having been corrected.

More specifically, the holding mechanism shown in FIG. 11 is such that the opposite side surfaces or the upper and lower surfaces of each magnet 15 are formed at its central portion with a pair of triangular projections engaged with any two opposite ones of a plurality of recesses formed on the inner surface of the case 41. With this arrangement, each magnet 15 can be stepwise moved inside the case 41.

While the upper and lower magnets 15 in the fourth preferred embodiment are vertically moved to change the magnetic fields formed by the magnets 15 vertically and asymmetrically, the magnets 15 may be moved along the horizontal axis of the cathode-ray tube 1 to thereby change the magnetic fields formed by the magnets 15 vertically asymmetrically.

While each magnet 15 is movable or rotatable in one direction in any of the above preferred embodiments, each magnet 15 may be held so as to make any combined movements of the above-mentioned movements in the above preferred embodiments. In this case, image distortion asymmetrical in both the horizontal direction and the vertical direction can be easily corrected.

While each of the deflection yokes in the above preferred embodiments employs a saddle-shaped horizontal deflection coil and a toroidal vertical deflection coil, the deflection yoke according to the present invention may employ a saddle-shaped vertical deflection coil, for example.

According to the present invention, the upper and lower magnets are held so as to be movable so that the magnetic fields formed by the magnets can be changed horizontally or vertically asymmetrically, thereby allowing easy correction of image distortion horizontally or vertically and asymmetrically.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A deflection yoke comprising:

upper and lower magnets having a substantially rectangular shape and being located at upper and lower positions on a funnel side of a cathode-ray-tube for correcting upper and lower image distortions;

first and second housings for respectively holding said upper and lower magnets in horizontal positions, as defined by a horizontal scan direction of the tube, at a top side and bottom side, respectively, of the funnel of said cathode-ray-tube, wherein the magnetic axes of said magnets are horizontal and fixed substantially perpendicular to a longitudinal axis of said tube; and adjustment means mounted on said first and second housings for linearly horizontally moving said upper and lower magnets held by said first and second housings, whereby when said adjustment means moves said upper and lower magnets in the same direction a trapezoidal image distortion is corrected, and when said adjustment means moves said upper and lower magnets in opposite directions a parallelogrammatic distortion is corrected.

2. A deflection yoke comprising:

upper and lower magnets having a substantially rectangular shape and being located at upper and lower positions on a funnel side of a cathode-ray-tube for correcting upper and lower image distortions;

first and second housings for respectively holding said upper and lower magnets in horizontal positions, as defined by a horizontal scan direction of the tube, at a top side and bottom side, respectively of the funnel of said cathode-ray-tube, wherein the magnetic axes of said magnets are horizontal and fixed substantially perpendicular to a longitudinal axis of said tube; and adjustment means mounted on said first and second housings for linearly vertically moving said upper and lower magnets held by said first and second housings to change respective distances between the upper and lower magnets and the longitudinal axis of said cathode-ray-tube, whereby when said adjustment means moves said upper and lower magnets in the same direction with respect to the axis of the cathode-ray-tube a vertically asymmetrical image distortion is corrected, and when said adjustment means vertically moves said upper and lower magnets in opposite directions with respect to the axis of the cathode-ray-tube a vertically symmetrical image distortion is corrected.

* * * * *